United States Patent [19]

Smith et al.

[11] 4,316,301

[45] Feb. 23, 1982

[54] PAINT ROLLER ASSEMBLY

[75] Inventors: Morley L. Smith, Beaconsfield; Gad Shaanan, Montreal, both of Canada

[73] Assignee: T. S. Simms & Co. Limited, Saint John, Canada

[21] Appl. No.: 134,912

[22] Filed: Mar. 28, 1980

[51] Int. Cl.[3] ..... B05C 17/02

[52] U.S. Cl. ..... 15/230.11; 29/110.5

[58] Field of Search ..... 15/230.11; 29/110.5, 29/116 R; 101/328, 329, 330, 331; 401/197, 208

[56] References Cited

U.S. PATENT DOCUMENTS

| | | | |
|---|---|---|---|
| 2,325,867 | 8/1943 | Matsakas . | |
| 2,751,618 | 3/1956 | Pruitt . | |
| 2,766,473 | 10/1956 | Thackara | 15/230.11 |
| 2,882,541 | 4/1959 | Easley . | |
| 2,965,911 | 12/1960 | Hempel et al. . | |
| 3,231,151 | 1/1966 | Clark et al. . | |
| 3,268,943 | 8/1966 | Melnyck . | |
| 3,354,493 | 11/1967 | Pharris . | |
| 3,363,726 | 1/1968 | Thomas | 15/230.11 X |
| 3,394,423 | 7/1968 | Bischoff | 15/230.11 X |
| 3,428,989 | 2/1969 | Baginski | 15/230.11 |
| 3,554,659 | 1/1971 | Stokes . | |
| 3,623,179 | 11/1971 | Roth | 15/230.11 X |
| 3,702,739 | 11/1972 | Rentfrow . | |
| 3,877,123 | 4/1975 | Pharris . | |

FOREIGN PATENT DOCUMENTS

| | | | |
|---|---|---|---|
| 113343 | 3/1969 | Denmark | 15/230.11 |
| 1112091 | 11/1955 | France | 15/230.11 |
| 289146 | 10/1953 | Switzerland | 15/230.11 |

*Primary Examiner*—Chris K. Moore

*Attorney, Agent, or Firm*—Fetherstonhaugh & Co.

[57] ABSTRACT

A paint roller assembly according to the present invention includes a support frame and a roller. The roller has a mounting passage which opens inwardly from one end thereof to a socket located at the other end thereof and the frame has an elongated shaft proportioned to fit within the mounting passage and formed with a plug which is adapted to be seated in the socket to retain the roller on the frame for rotation about the shaft portion of the frame.

3 Claims, 5 Drawing Figures

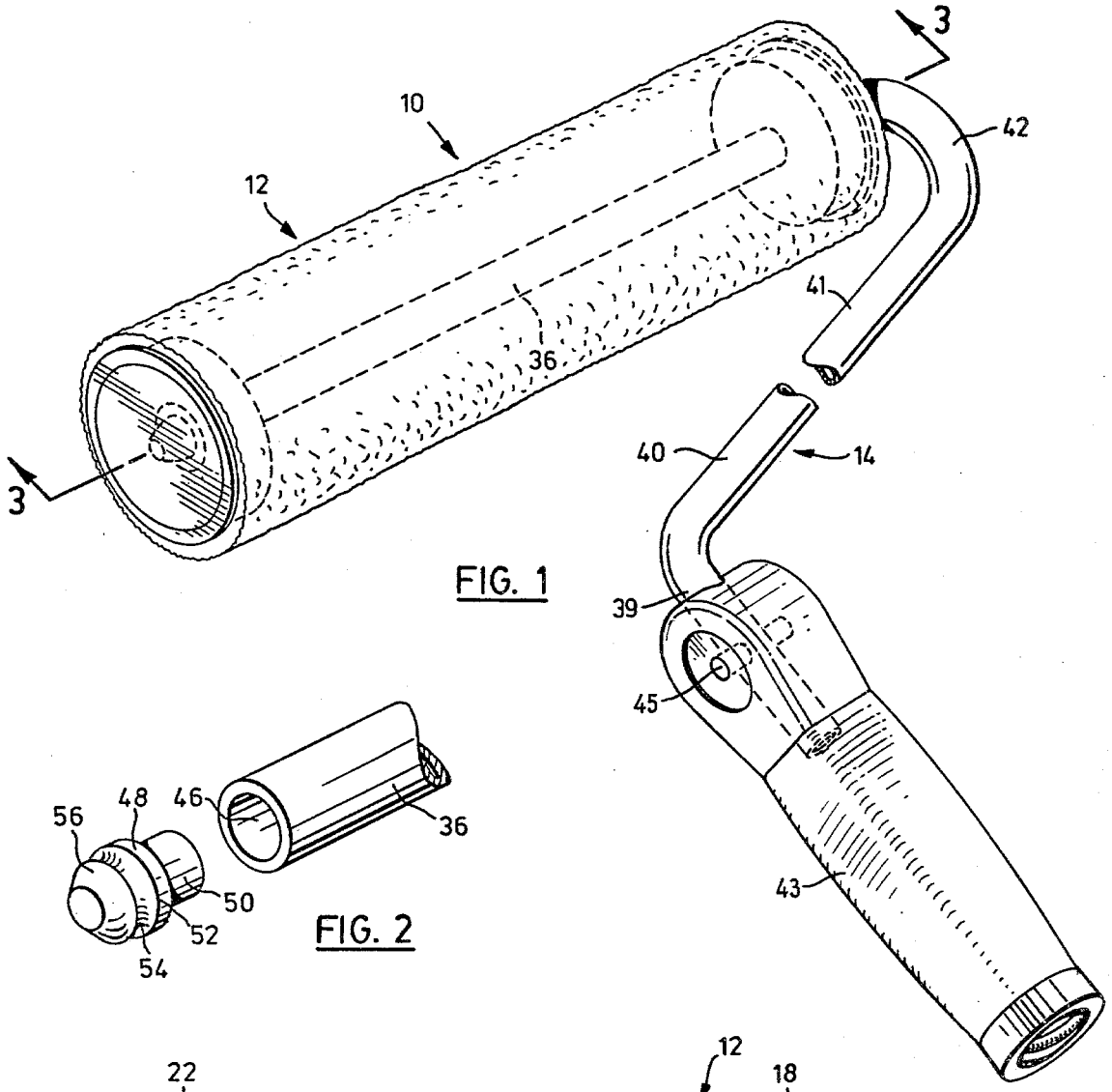
FIG. 1
FIG. 2
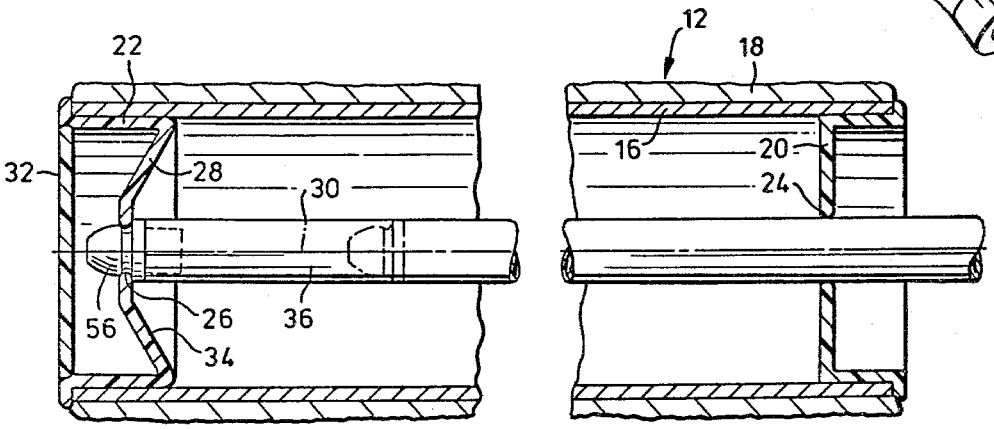
FIG. 3

PAINT ROLLER ASSEMBLY

FIELD OF INVENTION

This invention relates to paint roller assemblies.

Prior Art

It has been customary for many years to form the frame of a paint roller assembly from a solid metal rod. The solid metal rod is of a relatively small diameter, generally of the order of about ¼ inch, with the result that the frame is not very rigid. If the diameter of the frame is increased to significantly increase its rigidity, the weight of the frame would increase to such an extent that it would be difficult to manipulate the assembly manually and the cost of the frame would be considerably increased.

With the conventional solid metal rod frame, difficulty is experienced in attempting to secure the handle with respect to the frame. Frequently, the handle becomes loose with the result that the frame can rotate within the handle. After the handle was worked loose, it is very difficult to use the paint roller effectively and it is common to discard the entire frame which is otherwise quite functional.

In a conventional paint roller assembly, the roller member is retained on the shaft by mounting means located at each end of the shaft, the mounting means at the inner end of the shaft being in the form of a retaining washer resting on a shoulder formed by crimping the shaft and the outer end being retained by a threaded locking nut or mounting cap mounted on the free end of the shaft. Thus, in order to remove the roller it is necessary to release the threaded mounting nut or cap.

With the roller mounting system described in the preceding paragraph, it is necessary to use a roller of a predetermined length in association with each frame to ensure that the roller will fit the frame and will not be free to move longitudinally along the shaft when mounted on the frame. In the industry, the replacement rollers vary quite considerably in length with the result that the user is required to maintain a stock of frames proportioned to fit the various lengths of rollers.

SUMMARY OF INVENTION

The difficulties described above with respect to the manner in which a paint roller is releasably mounted on a paint roller frame have been overcome according to one aspect which comprises a roller having oppositely disposed first and second ends and a longitudinal axis of rotation extending therebetween, a mounting passage opening into said roller from said first end thereof along said axis of rotation, first mounting means in said roller aligned with said mounting passage, a frame having an elongated shaft for supporting said roller for rotation about said axis, said shaft having a free end insertable within said mounting passage through said first end of said roller, second mounting means on said shaft adapted to releasably engage and retain said first mounting means, in response to axial movement of said shaft relative to said roller, against movement in the direction of the longitudinal axis whereby said roller may snap on or snap off of said shaft in response to axial movement of said roller relative to said shaft.

PREFERRED EMBODIMENT

The invention will be more clearly understood after reference to the following detailed specification read in conjunction with the drawings, wherein FIG. 1 is a pictorial view of a paint roller assembly constucted in accordance with an embodiment of the present invention;

FIG. 2 is an exploded view of the end of the support shaft of the roller and its associated bearing plug;

FIG. 3 is a sectional view taken along the line 3—3 of FIG. 1;

Figure 4:
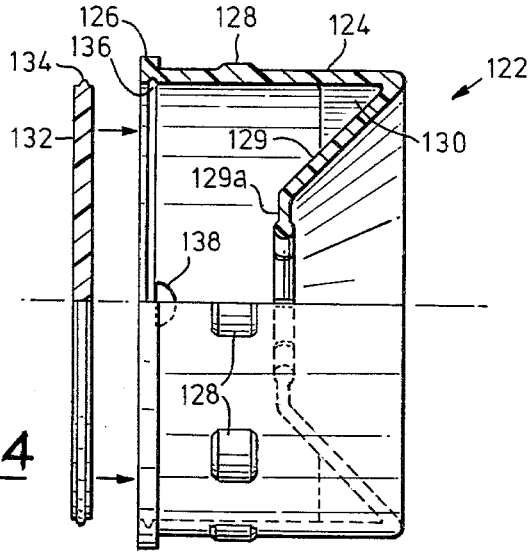
FIG. 4 is a pictorial side view of a paint roller bearing.

With reference to FIG. 1 of the drawings, the reference numeral 10 refers generally to a paint roller assembly which comprises a roller member generally identified by the reference numeral 12 and a frame generally identified by the reference numeral 14. The roller member 12 consists of a tubular support 16 and an outer cover 18. A first bearing member 20 is mounted in the first end of the tubular sleeve 16 and the second bearing member 22 is mounted in the second end thereof. The first bearing member 20 has a first bearing passage 24 extending therethrough. The second bearing member 22 has a collar 28 extending radially inwardly thereof to a socket 26 which opens therethrough in axial alignment with the first bearing passage 24 on the longitudinal axis of rotation 30 of the roller. An end cap 32 closes the end of the second bearing member 22 to prevent paint entering the bearing. It will be understood that end cap 32 may be formed as an integral part of the bearing member 22. The collar 28 has an angularly inclined surface 34 which is inclined toward the socket 26 and serves to guide the end of the support shaft 36 into engagement with the socket 26. The first bearing 20 and the second bearing member 22 are preferably made from a plastic material of a type suitable for use as a bearing material such as Teflon (Trade Mark) or the like. The collar 28 of the second bearing 22 is flexible.

The frame 14 is made from a hollow lightweight metal tube 40. The frame consists of a leg portion 39 from which an inclined portion 41 extends to a curved elbow portion 42 from which an elongated shaft 36 projects. The frame is proportioned so that the leg portion 39 is disposed substantially centrally between the ends of the shaft portion 36. A handle 43 fits over the free end of the leg portion 39 and is secured thereto by means of a rivet 45. Because of the large diameter of the tubular member 40 it is possible to secure the handle 43 to the frame by means of a rivet which serves to prohibit rotation of the frame about its connection with the handle. As a result of this construction, the handle of the present invention is much more securely fastened to the frame than was previously possible with a solid rod type frame.

As shown in FIG. 2 of the drawings, the shaft 36 has a passage 46 opening inwardly from the free end thereof. A bearing support member 48 is formed with a leg portion 50 adapted to fit within the passage 46 in a close fitting relationship. A shoulder 52 projects radially outwardly from the leg portion and has a diameter substantially equal to the external diameter of the shaft 36. A neck portion 54 of reduced diameter projects outwardly from the shoulder 52 to a head portion 56. The head portion 56 has a diameter which is larger than that of the socket 26 and the neck portion 54 has a diameter which fits within the socket 26 in a free sliding relationship. The neck portion 54 is shaped and proportioned to receive the peripheral edge of the socket 26. The collar 28 is sufficiently flexible to permit the head portion 56 to be inserted into and withdrawn from the socket 26 to permit the roller to be snapped on and snapped off the shaft 36. When identifying paint rollers, it is customary to refer to the "roller diameter" which is the internal diameter of the roller.

The tubular frame 40 has a diameter which is sufficient to ensure that the frame as a whole is substantially rigid. Generally, the frame diameter will be at least 20% of the roller diameter and is preferably equal to about 30% of the roller diameter. The use of a large diameter shaft permits the bearing passage 24 of the first bearing to be formed so as to bear directly against the outer periphery of the shaft 36. Similarly, the diameter of the neck portion 26, which forms an integral part of the shaft when the bearing support member 48 is mounted thereon, is at least 20% of that of the roller diameter. A standard paint roller has a roller diameter of the order of about 1½ inches and a tubular metal frame member of the present invention suitable for use with such a standard roller is preferably made from a hollow aluminum tube having an external diameter of the order of about ½ inch and a wall thickness of about 1/16 inch, this being sufficient to provide an adequate degree of rigidity to the frame, the external diameter of the neck 26 in this configuration being about ⅜ of an inch.

It will be apparent that the use of a flexible mounting permits the roller to be mounted on and removed from the shaft with ease. Furthermore, by locating the releasable mounting device at the free end of the shaft, the positioning of the roller on the shaft is not influenced by the length of the roller. As a result, rollers of different lengths may be mounted on the support frame. These and other advantages of the apparatus of the present invention will be apparent to those skilled in the art.

FIG. 4 of the drawings provides a more detailed illustration of a second bearing member which is generally identified by the reference numeral 122. The second bearing member 122 has a cylindrical side wall portion 124 from which a lip 126 projects radially at one end thereof. A plurality of short protrusions 128 are formed at spaced intervals about the periphery of the cylindrical portion 124 and serve to secure the bearing member 122 within a paint roller refill in use. An end plate 132 has a peripherally extending ridge 134 proportioned to fit within an annular groove 136 formed in one end of the bearing member 122. A small semi-circular passage 138 is provided in the cylindrical wall 124 adjacent the position which the end wall 132 will assume when in an operative position. The passage 138 provides access to the interior of the bearing 122 sufficient to permit the removal of the end wall 132 as required. The collar portion 128 of the bearing is rigidified by a plurality of structural ribs 130 which extend radially between the angularly inclined portion of the collar 128 and the cylindrical side wall 124 at circumferentially spaced intervals thereabout. The inner portion **128*a* of the collar is divided up into a plurality of segments 134 by slots 136. The slots serve to increase the flexibility of the collar portion 128 to facilitate the insertion and removal of the bearing support member 56**.

Figure 5:
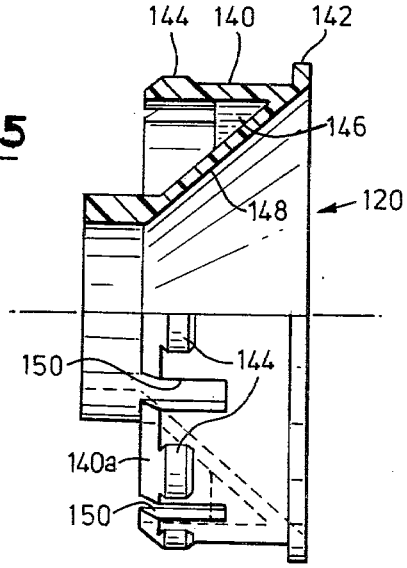
FIG. 5 is a pictorial side view of a second bearing for use with a paint roller.

FIG. 5 of the drawings illustrates the structure of a first bearing member 120 in detail. The first bearing member includes a cylindrical side wall portion 140 which has a lip 142 at one end thereof. A plurality of short ridges 144 are formed at circumferentially spaced intervals about the cylindrical side wall portion 140. A plurality of stiffening ribs 146 project radially inwardly from the cylindrical side wall 144 to the inner wall 148 at circumferentially spaced intervals. The cylindrical wall 140 is divided into a plurality of spaced segments **140*a* by slots 150 which extend inwardly from the free end of the side wall 140. The segments 140*a* are sufficiently flexible to facilitate the entry of the bearing member 120 within the end of a roller. The collar 152 has a through passage 154 proportioned to receive a shaft 36** in a close fitting sliding relationship.

These and other modifications of the structure illustrated in FIGS. 1 to 3 of the drawings will be apparent to those skilled in the art.

What I claim as my invention is:

1. A paint roller assembly comprising, (a) a metal frame which is bent upon itself to provide a handle mounting leg portion and an elongated shaft portion having one end joining said handle portion, the frame being made of hollow tubular material, whereby to provide simultaneously a lightweight and rigid frame.

(b) a plug mounted in and closing the other end of the shaft portion of the frame, and having a head portion extending away from the shaft portion and tapering down from about the diameter of the shaft portion to a smaller diameter, and the plug having a neck portion located between the head portion and the shaft portion and of smaller diameter than the shaft portion; and (c) a roller having a tubular sleeve, first and second bearing members mounted in opposite ends of the sleeve, the first bearing member having a first bearing passage sized to receive the shaft portion of the frame, and the second bearing member having a socket portion extending inwardly from the sleeve and having a second bearing passage smaller in diameter than the diameter of the shaft portion and sized to fit into said neck portion, the collar being sufficiently flexible to expand and let the head portion of the plug be forced therethrough, whereby the plug serves to removably retain the second bearing member on the hollow shaft.

2. A paint roller assembly as claimed in claim 1, wherein said socket portion of the second bearing member has surfaces inclined toward the second bearing passage and away from the first bearing member to guide the plug into the second bearing passage, and the second bearing member having a disc shaped end plate closing the end of the roller.

3. A paint roller assembly as claimed in claim 1, further comprising a handle, a part of the handle portion of the hollow frame projecting into said handle, and rivet means extending through said handle and said part of the hollow frame to secure said handle with respect to said part of the frame and prevent rotation of said handle with respect to the frame.

* * * * *